United States Patent [19]

Petriello et al.

[11] 4,434,197

[45] Feb. 28, 1984

[54] NON-STICK ENERGY-MODIFYING COOKING LINER AND METHOD OF MAKING SAME

[75] Inventors: John V. Petriello, Huntington, N.Y.; Michael N. La Torra, North Palm Beach, Fla.

[73] Assignee: N. F. Industries, Inc., Winston-Salem, N.C.

[21] Appl. No.: 411,350

[22] Filed: Aug. 25, 1982

[51] Int. Cl.[3] ..... B05D 1/36

[52] U.S. Cl. ..... 427/407.1; 219/10.55 E; 428/422; 426/244

[58] Field of Search ..... 427/407.1; 426/244, 426/234, 241; 264/212, 127; 219/10.55 E; 428/422

[56] References Cited

U.S. PATENT DOCUMENTS

| | | | |
|---|---|---|---|
| 2,852,811 | 9/1958 | Petriello | 264/127 X |
| 2,923,651 | 2/1960 | Petriello | 264/127 |
| 2,976,093 | 3/1961 | Reiling | 264/127 X |
| 4,190,757 | 2/1980 | Turpin et al. | 426/234 X |
| 4,230,924 | 10/1980 | Brastad et al. | 219/10.55 E |
| 4,267,420 | 5/1981 | Brastad | 219/10.55 E |

FOREIGN PATENT DOCUMENTS

| | | | |
|---|---|---|---|
| 7208704 | 12/1972 | Netherlands | 264/127 |

*Primary Examiner*—Thurman K. Page
*Attorney, Agent, or Firm*—Grover M. Myers

[57] ABSTRACT

A flexible multi-layer structure having at least one layer pigmented with a color and/or an energy absorber with the outer two layers consisting of pure polytetrafluoroethylene to provide a food contacting surface.

3 Claims, 6 Drawing Figures

NON-STICK ENERGY-MODIFYING COOKING LINER AND METHOD OF MAKING SAME

FIELD OF THE INVENTION

The present invention relates to a composite multi-laminar film structure for use in the preparation of food, and more particularly, to a flexible film sheet which can be used in both a conventional oven and a micro-wave energy oven as a non-stick reuseable liner or self-basting cover and in a microwave oven as an energy moderator to permit browning and crisping of food.

BACKGROUND OF THE INVENTION

In order to understand the full range of the present invention, it is necessary to discuss some of the efforts of the past to assist in the preparation of food and, in particular with regard to cookware, to make cooking and clean-up less time consuming. In recent years many different types of cookware; such as frying pans, cookie sheets and the like, have been developed which have non-stick surfaces to prevent substances from sticking to the cookware surface during food preparation and thus aid in clean-up. There also have been aerosol sprays which are sprayed into pan surfaces which prevent sticking, thereby aiding in clean-up. One of the primary advances in this art was the development of polytetrahaloethylene, such as polychlorotrifluoroethylene, and in particular, polytetrafluorethylene which is marketed under the name Teflon (a registered trademark of the E. I. duPont de Nemours Co. of Wilmington, Del. 19898). The same polymer is manufactured by other companies and may be marketed under other trademarks.

Polytetrafluoroethylene is noted for its anti-stick qualities, relative inertness, high temperature resistance and in many forms is approved by the Federal Food and Drug Administration (FDA) for food contact use. The Teflon coated frying pans, metal cookie sheets, etc. have a layer of polytetrafluoroethylene adhered directly to the metal surface which provides the non-stick characteristic to permit easy clean-up. Although improvements have been made over the years in polytetrafluoroethylene coated utensils, there are still attendant problems. For example, the coating soon becomes scored or scratched through the use of sharp utensils or improper use of scouring pads during cleaning. Additionally, the fully adherent polytetrafluoroethylene layer is prone to trap odors from rancid or decomposed shortening and food, thus imparting an undesirable taste to ensuing cooked or baked foods. Washing out the malodorus or bad tasting components permeated through the polytetrafluoroethylene coating is difficult to achieve because only one surface of the polymer is exposed. What is needed is a totally removable non-adherent interlayer or liner between the utensil and the baked or cooked items so that the liner can be divested of any permeated or residual food components by soaking or washing in normal detergents on both sides.

Polytetrafluoroethylene has not only been used in cookware and numerous other coating applications but it has been produced as a thin film for additional applications such as cookware liner, electrical tape, and other industrial applications. The film can be produced by various methods including skiving and casting which are generally described in the background description of U.S. Pat. No. 2,852,811. Although thin polytetrafluoroethylene film has been used as a cooking liner in the past, it did not meet with great acceptance. The general physical characteristics of such films and particularly the transparency led the consumer to confuse the polytetrafluoroethylene film with ordinary polyethylene films such as are used in sandwich bags or as coverings for freshly cleaned clothing. As is commonly known, polyethylene should not be used in conventional ovens, such an error would result in the material melting or burning with subsequent harmful vapors being released.

A more recent advance in food preparation or cooking is the advent of the microwave energy ovens which are now commonplace. One of the primary problems with the microwave energy is that it fails to provide the proper so-called browning and/or crisping to the foods which are normally expected to have such a quality. Therefore, foods of this type after being heated or cooked in the microwave, do not possess the degree of appeal and taste normally expected.

Many attempts have been made to correct this lack of browning when microwave energy is used. One attempt to solve the browning problem is the inclusion of various modifications such as an electrical broiler element in the microwave oven to produce the short-wave energy needed to brown food. Another solution has been to use various types of eatable coatings, which only add the appearance of surface browning.

Other attempts at solving the browning problem have been directed at modifications of the microwave energy itself by using special utensils, pans and packages to convert the high frequency microwave energy by resistance losses into heat. Heat gives the requisite browning effect and coloration to the food.

Some of these special utensils, pans and packages are illustrated in U.S. Pat. Nos. 3,302,632; 3,701,872; 3,777,099; 4,190,757; 4,230,924 and 4,268,738. Of particular interest with respect to the present invention are the special packages illustrated in the last three above-mentioned patents.

U.S. Pat. No. 4,190,757 to Turpin discloses a disposable microwave shipping, heating and serving package composed of a paperboard carton and a lossy microwave energy absorber which becomes hot when exposed to microwave radiation. The absorber is in a conductive heat-transfer relationship with the food product and the package and is usually bonded to a structural supporting sheet such as aluminum foil. The metal foil sheet is adapted to reduce by a specific amount the direct transmission of microwave energy into the food by providing holes of selected size within the sheet. Besides being expensive to manufacture and not reuseable, these types of packages do not provide intimate contact with all parts of the food being prepared and must be customized for each food item so that the package must be supplied by the food processor.

U.S. Pat. No. 4,230,924 to Brastad et al discloses a flexible dielectric substrate in the form of a sheet of plastic or paper having a metallic coating thereon. The metallic coating is sub-divided into a number of metallic islands or pads with non-metallic gaps or strips between. The size of the gaps can be varied and, thus, permit selected amounts of microwave energy to be transmitted through the sheet. Although the sheet is described as flexible, the foil sheet detracts from its flexibility and prevents it from being draped or wrapped around the food to produce an intimate contact.

U.S. Pat. No. 4,268,738 to Flautt, Jr. et al discloses a material which can be used as a package bag or wrapper which has a microwave moderator that enables microwave cooking of frozen foods at relatively high microwave oven power levels without requiring pre-cooking, defrosting or overpower level changes. One species of the moderator is a wrapper which comprises a perforated sheet of microwave reflective material; for example, aluminum foil. The perforated sheet is provided with a plurality of generally uniformed spaced apertures which are sufficiently large with respect to the wave length of the microwave energy that a substantial portion of the energy directed at the moderator will pass through. The perforated sheet can be sandwiched between thermoplastic films which are substantially transparent to microwave energy and have a relatively low dielectric loss factor and which are substantially impervious to other vapors or liquids encountered in cooking. Examples of such films are polypropylene, polyethylene, fluorocarbons and polyimides. Again, this type of package although useful is expensive to manufacture and is normally not reuseable when made into packages as suggested in the disclosure.

SUMMARY OF THE INVENTION

The nature of the present invention will be more readily appreciated when considering the major objects and purposes, the principle purposes and objects are which recited in the following paragraphs in order to provide a better appreciation of the important aspects describing the details of the preferred embodiment in later portions of this description.

It is an object of this invention to provide a highly flexible sheet of polytetrafluoroethylene of a multi-laminar structure wherein at least one of said laminar contains a microwave energy absorbing material.

Another object of this invention is to provide a highly flexible sheet of polytetrafluoroethylene of a multiple layer structure wherein the loading of microwave energy absorbing material may be varied so that the surface temperature of the sheet can be subsequently regulated.

Another object is to provide a highly flexible sheet of polytetrafluoroethylene which may be temperature regulated in a microwave oven and having the outer surfaces of the sheet in contact with the food as non-contaminating.

Another object of this invention is to provide a multi-laminar polytetrafluoroethylene flexible sheet which is non-contaminating to food and has a uniformly dispersed loading of a semi-conductive material which does not detract from the flexibility of the sheet.

Another object of this invention is to provide a multi-laminar polytetrafluoroethylene structure for use as a cooking aid in both conventional and microwave ovens, said structure having a pigment in at least one of the layers to provide a distinctive color to the sheet.

Still another object of this invention is to provide a multi-layer sheet of polytetrafluoroethylene wherein loading of the microwave energy absorbing material is regulated in one or more layers so that the surface temperature of the sheet may be controlled while sufficient microwave energy passes through the sheet.

A further object of this invention is to provide a multi-laminar modified sheet of polytetrafluoroethylene which will enable microwave heating of food internally as well as surface heating by virtue of contact with the temperature regulated sheet surface.

These and other objects of the present invention are accomplished through the use of a flexible multi-layer structure having at least one layer colored with a pigment and/or a energy absorber with the outer two layers consisting of pure polytetrafluoroethylene to provide a food contacting surface as will be described more fully hereinafter.

BRIEF DESCRIPTION OF THE DRAWINGS

While the specification concludes with claims particularly pointing out and distinctly claiming the subject matter regarded as forming the present invention, it is believed that the invention will be better understood from the following description taken in connection with the accompanying drawings in which:

DESCRIPTION OF A PREFERRED EMBODIMENT

Figure 1:
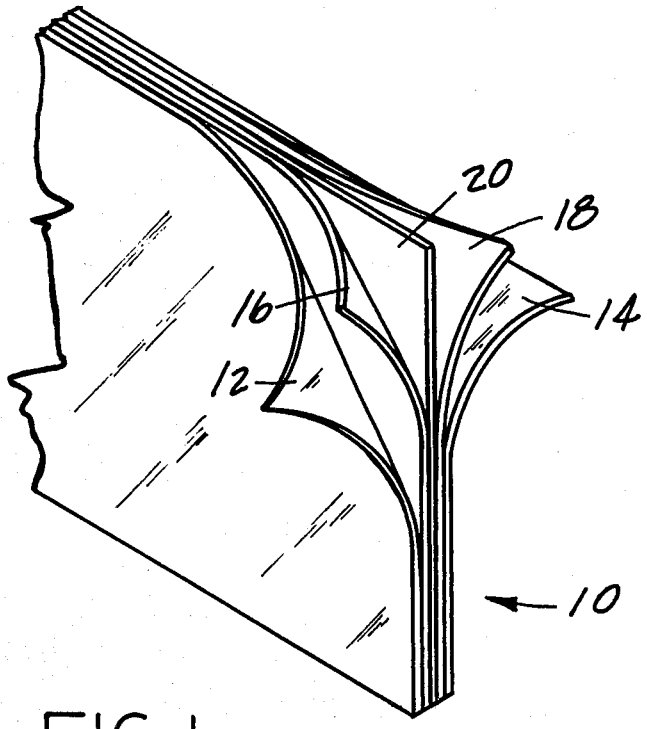
FIG. 1 is a perspective view of a flexible polytetrafluoroethylene laminated film structure according to the present invention having the layer partially peeled back.

In FIG. 1, the numeral 10 indicates a multi-laminar flexible sheet structure having five layers including outside layers 12 and 14 of polytetrafluoroethylene, two intermediate layers 16 and 18 of pigmented polytetrafluoroethylene and a central layer 20 of polytetrafluoroethylene containing an energy absorber. The types of pigment and semi-conductive or energy absorber materials will be discussed hereinafter.

The terms multi-layer or multi-laminar as used herein should not be construed to be laminate structures which are normally formed by either adhesive bonding layers of material together or by hot press or hot roll fusing or melting materials in sheet or strip form so that joining takes place at the surface interfaces.

As will be described in more detail, the multi-layer or multi-laminar films of this invention are formed in individual layers or laminae. However, due to the nature of the process as later described, each layer becomes a contiguous part of each previously formed layer, and although microtomed cross-sections of the film as viewed under a microscope at about 150 power clearly shows a striation or multi-laminar effect, the film is completely contiguous in all its physical characteristics. This condition remains the same even though other components in finely divided form are added to one or more layers of the laminate structure. A notable advantage in films made by the ensuing process, with or without addition, is their extreme flexibility.

The sheet 10 can be of any desired size or conformed shape and can be used in many ways, for example, as a liner for cookware, such as boilers, trays, pans, cookie sheets to prevent food from sticking to the cookware while baking and, thus, eliminating scrubbing and scouring of the pot or pan. The liner may be placed on top of food such as poultry to create a self-basting effect. It may also be used as a non-stick drip liner for conventional ovens, microwaves, refrigerator/freezers. Finally, the flexible liner is safe for use in microwave ovens and acts as an energy absorber to produce heat and permit browning and crisping of the food. The semi-conductive material used as the microwave energy absorber surprisingly enough not only absorbs a portion of the microwaves, but allows sufficient energy to pass through the sheet so that food contained within or wrapped in the sheet will properly cook in about the same time as would normally be required if the sheet were not utilized.

The flexible sheet 10 is extremely thin being between approximately 1 to 2 mls. and is produced in a casting process as will be explained hereinafter. The loading of the pigment and energy absorber materials may be varied depending upon the primary purpose of the sheet, for example, the loading of the semi-conductor can be regulated so that, when the sheet is exposed to microwave energy for a specific period of time, the sheet will obtain a temperature of up to 450° F. Additional semi-conductive material may also be added to permit the sheet to be heated even higher, however, there is a limit to the temperature range of the polytetrafluoroethylene material and this is one of the limiting factors in loading of the energy absorber.

Other embodiments of the sheet are illustrated in FIGS. 2–5 and, although they are preferred, other variations are considered to be within the present invention.

Figure 2:
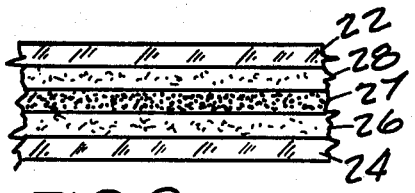
FIGS. 2–5 are cross-sections of various embodiments of the flexible polytetrafluoroethylene sheet in accordance with the present invention.

FIG. 2 illustrates the cross-section of a thin flexible polytetrafluoroethylene sheet approximately 1.5 mls. which has two outer layers 22 and 24 of pure polytetrafluoroethylene. The three inner layers 26, 27 and 28 contain or are loaded with a semi-conductive or energy-absorbing material such as a colloidal graphite, available under the tradename "Aquadag E" and sold by Acheson Collids Col, Port Huron, Mich. Ferric oxide and carbon are other possible additives which may be used as energy absorbers. The particulate size of these additives should be such that they will uniformly disperse with the particles of polytetrafluoroethylene forming in effect a co-dispersion. Aquadag E has a particulate size in the range of 10–20 milli-microns, therefore, is highly suitable for co-dispersion mixes. If desired, a three-layer structure can be used with the outer layers being pure polytetrafluoroethylene and a central layer containing all of the semi-conductive material. However, for ease of manufacture, it is preferable that five layers be used. When using a five-layer structure, the semi-conductive materials can be loaded in a single layer or all three interior layers.

Another embodiment of the thin flexible sheet approximately 1.5 mls. is illustrated in cross-section in FIG. 3, and again includes two outer layers 30 and 32 of pure polytetrafluoroethylene with two intermediate layers 34 and 36 of a co-dispersion of polytetrafluoroethylene and a coloring pigment. The central layer 38 contains a loading of about 10% by weight of semi-conductive material such as colloidal graphite. The pigment used to color the sheet can be of any color but a neutral color is preferable. The particle size of the pigment shall be approximately 1–3 microns for proper dispersement in the polytetrafluoroethylene dispersion. Typical pigments which may be used are titanium dioxide, Product #5710 of the H. Kohnstamm & Co., Inc., New York, N.Y. or various pigments of the Ferro Corp., Cleveland, Ohio such as cadmium sulphide red (Product Code #V-08845), Chrome/cobalt green (Product Code #V-07687), oxides of cobalt/zinc-/aluminum blue (Product Code #F-06279) and cadmium sulphide yellow (Product Code #V-09820). The method of incorporating the pigment in the film will be explained hereinafter.

Figure 4:
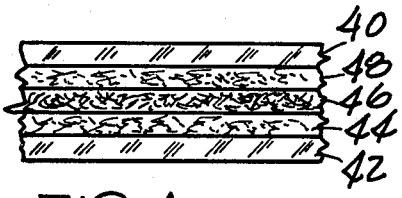
Figure 5:
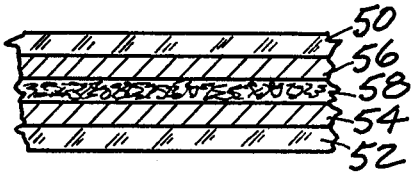

FIG. 4 illustrates a thin film structure similar to FIG. 2 in that the two outer layers 40 and 42 of pure polytetrafluoroethylene and the three inner layers 44, 46 and 48 contain a loading of an energy-absorber or modifying material such as ferric oxide. Finally, FIG. 5 illustrates a modified film having two outer layers 50 and 52 of pure polytetrafluoroethylene, pigmented layers 54 and 56 and a central layer loaded with 10% by weight of ferric oxide energy-absorbing material.

Figure 6:
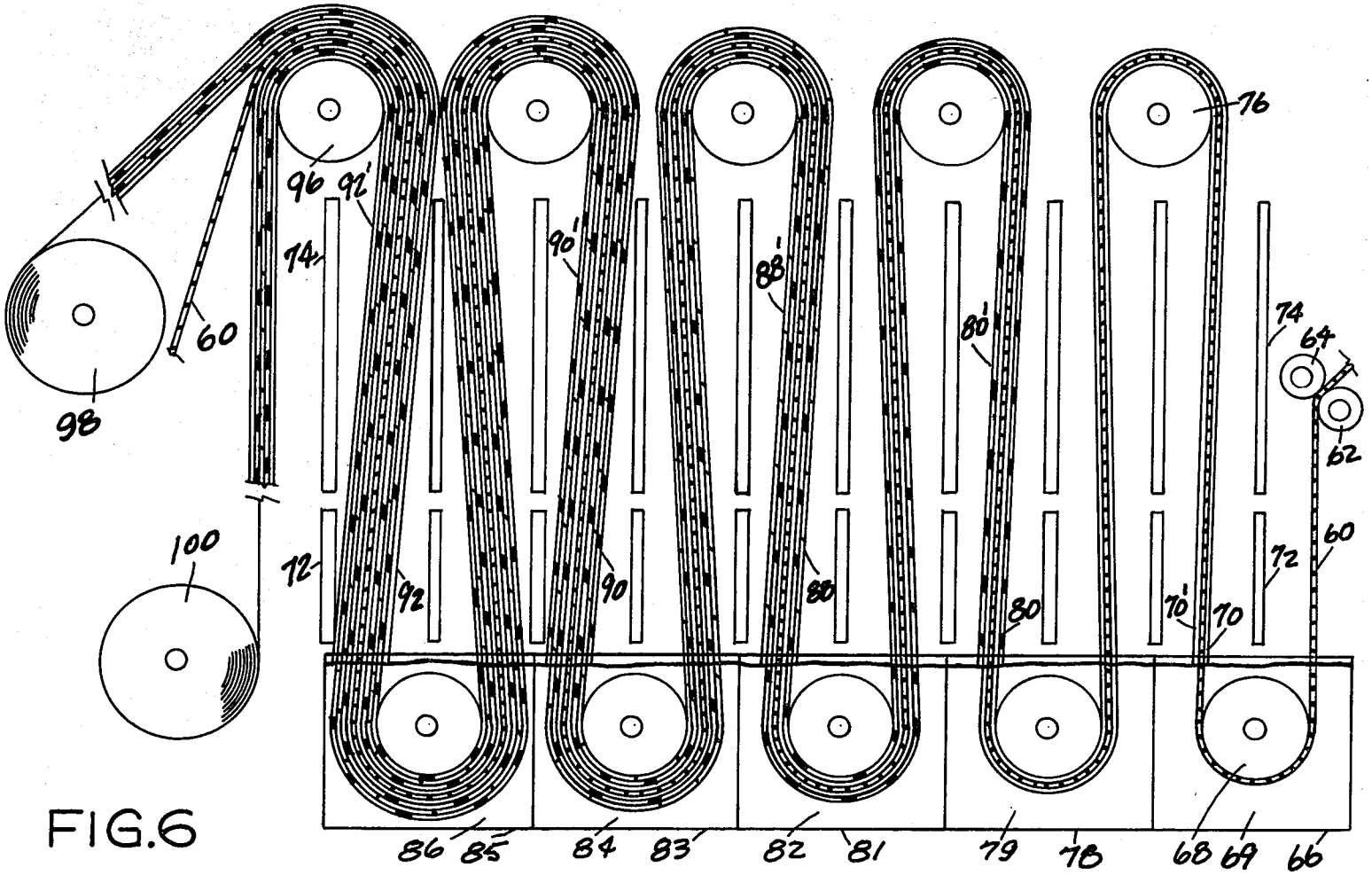
FIG. 6 is a schematic of one embodiment of an apparatus which can be used in manufacturing the flexible polytetrafluoroethylene sheets according to the present invention.

Turning now to a description of the process for manufacturing the various sheet structures discussed hereinabove. The process used to manufacture the thin multi-laminar film is generally described in U.S. Pat. No. 2,852,811 issued to John V. Petriello, who is a co-inventor of the present invention. The specifications of U.S. Pat. No. 2,852,811 is hereby incorporated herein by reference. The processing includes depositing a layer of a liquid dispersion of particles on a metal carrier, drying and sintering the layer to form a film structure which shall be referred to therein and defined as casting. Each of the embodiments described above specify five layers; however, by modifying the solids content (varying the percentage of solids in the dispersions utilized to manufacture the film) the above process can be used to manufacture a three-layer thin film. It is believed, however, that by utilizing five layers, a more preferred product is produced. Therefore, the process as described herein and illustrated in FIG. 6 is directed to a multi-laminar structure of five layers.

The multi-laminar sheet or film which has been referred to herein is manufactured from polytetrafluoroethylene dispersion. A typical polytetrafluoroethylene dispersion would be available under Product Code T-30 and may be purchased from E.I. DuPont Nemours Company in Wilmington, Del. The T-30 dispersion contains about 60% polytetrafluoroethylene solids with about 7% "Triton" X-100 which is a surface-active aryl-alkyl polyether surfactant available from Rohm & Haas Corp. in Philadelphia, Pa. Other ingredients include a slight amount of a fluorocarbon stabilizing agent and de-ionized water. For the purposes of this invention, the polytetrafluoroethylene T-30 dispersion is further diluted with a mixture of Triton X-100 and de-ionized water. The polytetrafluoroethylene solid content of the prepared dispersion is measured by means of specific gravity.

The determination of the polytetrafluoroethylene solid content is important and the relationship of the solids to specific gravity in aqueous collodial dispersions of polytetrafluoroethylene has been formulated by John F. Lomtz and William B. Happoldt Jr. and published in an article entitled "Teflon Tetrafluoroethylene Resin Dispersion", Industrial and Engineering Chemistry, Vol. 44, Aug. 1952.

Again, the multi-laminar sheet of polytetrafluoroethylene is cast as generally disclosed in U.S. Pat. No. 2,852,811 and modifications in one or several of the casting modes are made to meet the embodiments of the present invention.

In FIG. 6, the numeral 60 indicates a light gauge flexible, stainless steel belt or strip traveling through buffing rollers 62 and 64 and downwardly into a container or dip tank 66 containing an aqueous dispersion of polytetrafluoroethylene particles. The belt 60 passes under a roller 68 traveling upwardly from the container 66 and emerges from the bath 69 coated with wet layer 70 and 70' of the dispersion material contained in dip tank 66. As the coated belt emerges from the bath, it passes through a drying oven 72 where the water is evaporated from the coating and then to a sintering oven 74.

The belt 60 and layers 70 and 70' are carried over an upper roller 76 and again downwardly into a second dip tank 78 containing another dispersion bath 79. Upon emerging from the bath 79, outside layers 80 and 80' are coated on the previously formed layers 70 and 70' with the belt being a center carrier. The belt carrier 60 passes through a drying oven and a sintering oven where the contacting layers 70 and 80 and 70' and 80'; respectively, are dried and fused together. As the belt 60 continues down the process passing through dip tanks 81, 83 and 85 containing baths 82, 84 and 86, respectively, additional layers are applied to the outside layers previously formed. Layers 88 and 88' are formed in bath 82, 90 and 90' in bath 84 and 92 and 92' in bath 86. After emerging from each bath, the belt 60 containing the added layers is passed through drying and sintering ovens so that the added layers are dried and fused to the next adjacent layer. Upon emerging from the final sintering oven 94, the multi-laminar structure passes over a final roller 96. The multi-laminar structure of the polytetrafluoroethylene material on each side of the carrier belt 60 is stripped from the belt and directed onto take-up rolls 98 and 100.

For a better understanding of the process, we turn now to the content of the various dip tanks or containers. The description of the content of the dip tank will be directed specifically to the forming of a sheet similar to the sheet illustrated in FIG. 2; however, it should be understood that the baths can be modified and the content depends on the type of product desired.

Dip tank 66 contains a prepared T-30 polytetrafluoroethylene dispersion having a specific gravity ranging from 1.2 to 1.3 for which a film measuring approximately 0.3 mls is cast upon the vertically moving stainless steel web carrier. Upon completion of drying and heat fusion of the coating carried on the stainless steel belt carrier, it passes through dip tank or container 78 which contains a modified T-30 polytetrafluoroethylene dispersion with approximately 90% polytetrafluoroethylene solids in proportion to 5% collodial graphite by weight, diluted with Triton X-100 and de-ionized water to a specific gravity range of 1.2 to 1.3. In order to preserve the stability of the modified dispersion mixture of polytetrafluoroethylene and collodial graphite, controlled amounts of ammonium hydroxide are added to maintain a pH of 10–11. Emerging from dip tank 78 and the drying and the sintering ovens, the coated stainless steel carrier is now coated with an additional layer of modified polytetrafluoroethylene about 0.3 mils so that the total film cross section is 0.6 mils thick.

The dip tanks 83 and 85 likewise contain the same modified dispersion as dip tank 78 and the same casting procedure is repeated thereby building up the film structure to approximately 0.9 mls. thickness. As now constructed, the multi-laminars 90 and 90' have three layers of polytetrafluoroethylene containing collodial graphite, with an outer layer of pure polytetrafluoroethylene.

The final dip tank 85 contains a polytetrafluoroethylene diluted T-30 dispersion as is in dip tank 66. The final layer of polytetrafluoroethylene is cast over the previous layers and is approximately 0.3 mls. so that the total thickness of the multi-laminar structures 92 and 92', when completely dried and heat fused, are approximately 1.2 mils. The complete multi-layered structure film can then be stripped in rolled form 98 and 100 from the stainless steel carrier 60.

Figure 3:
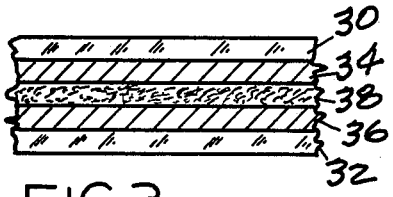

Although the above description illustrates only a loading of a semi-conductive material, it should be understood that, if desired, and as illustrated in FIGS. 3 and 5, an inorganic pigment in finely-defined form can be mixed with the dispersions in the dip tanks to form a pigmented layer as opposed to an energy-absorbing layer. It is necessary that the pigment be ground or reduced to particle size range of approximately 1–3 microns. This permits the pigment to be uniformly dispersed with the diluted polytetrafluoroethylene dispersion thereby forming a suitable co-dispersion of the two materials. Pigment loading based on a polytetrafluoroethylene solids weight basis may vary from 1–10%. The pigment loading should be adjusted so that the acquired co-dispersion has a specific gravity of approximately 1.2 to 1.4.

As presently constituted, the semi-conductive material can be collodial graphite, carbon, ferrous oxide or any other material which will act as an energy absorber and can be used in the dispersions described herein above. Furthermore, the load percentage of graphite solid can range from 1% to 20% and is dependent upon the temperature at which the film is to be used. For example, at a 4% collodial graphite loading with a 1½ mil film thickness, a sheet will heat up to a temperature of 450° F. when exposed to microwave energy for approximately one minute.

Again, it should be understood that the above are only illustrations of the types of films which can be produced and which are considered within the scope of the present invention.

It is believed that modifications to the system can be made by loading the tanks with a combination of semi-conductive material and pigment as long as the solution of the dispersion contains the correct specific gravity.

From the above it can be seen that a thin flexible polytetrafluoroethylene sheet can be formed which contains an energy absorber in either combination or alternately a pigmented material to provide for a non-stick liner material which can be utilized in both conventional and microwave ovens. In a microwave oven, the liner can be used as a browning aid. The sheet can be utilized to wrap the food completely so that all surfaces of the food will be contacted by the sheet and heated by the energy absorption to brown all areas of the food. The invention also provides for a complete dispersion of the energy-absorbing material within the sheet to permit total flexibility. The sheet can be reused since it is simply removeable and can be washed either by hand or in a dishwasher. Finally, the material can be used on a number of different types of cookware. By regulating the loading of the energy-absorbing material when preparing the material, the sheet can be prepared for use at different temperature ranges. The sheet is simple and easy to manufacture and very inexpensive as compared to other known forms of heat-modifying devices used for microwave ovens.

While several embodiments of the present invention have been described herein, many modifications as illustrated above may be devised and used and it is not intended to hereby limit the invention to the embodiment shown or described. The terms used in describing the invention are used in their descriptive sense and not in the terms of limitation, it being intended that all of the equivalent.

These variations and modifications can be made to the invention as above described and illustrated without departing from the true spirit and scope thereof as defined in the following claims.

We claim:

1. The method of manufacturing a thin, flexible film for use as a cooking aid comprising the steps of:

(a) forming a first layer of pure polytetrafluoroethylene by depositing a liquid dispersion on a carrier, drying and sintering said liquid dispersion;

(b) forming a second layer on said first layer by depositing a liquid co-dispersion of polytetrafluoroethylene and a particulate energy-absorbing material, the percent solid content of said particulate energy-absorbing material being between 1% to 20%, drying and sintering said liquid co-dispersion; and (c) subsequently, forming a third layer of pure polytetrafluoroethylene on the second layer by depositing a second liquid dispersion, drying and sintering said second liquid dispersion.

2. A method of claim 1, wherein the step of forming the second layer is carried out in three separate depositing, drying and sintering steps with the specific gravity of the liquid co-dispersion of polytetrafluoroethylene and energy-absorbing material is approximately 1.2 to 1.3.

3. The method of claim 1, wherein the step of forming the second layer is carried out in three separate depositing, drying and sintering steps forming a first intermediate layer, a central layer and a second intermediate layer, the liquid co-dispersion for said first and second intermediate layers includes polytetrafluoroethylene and a coloring pigment with a percent-solid content of pigment between 1% to 10% by weight and a specific gravity of approximately 1.2 to 1.3 and the liquid co-dispersion for said central layer includes polytetrafluoroethylene and an energy-absorbing material with a percent-solid content of energy-absorbing material between 1% to 10% by weight and a specific gravity of approximately 1.2 to 1.3.

* * * * *